United States Patent [19]

Fessler et al.

[11] 4,333,587

[45] Jun. 8, 1982

[54] BEVERAGE DISPENSER

[75] Inventors: Herman S. Fessler, Coon Rapids, Minn.; William A. Harvill, Stone Mountain, Ga.

[73] Assignees: The Coca-Cola Company, Atlanta, Ga.; The Cornelius Company, Anoka, Minn. ; part interest to each

[21] Appl. No.: 117,330

[22] Filed: Jan. 31, 1980

[51] Int. Cl.[3] ..... B67D 5/56

[52] U.S. Cl. ..... 222/129.1; 222/130; 222/135; 222/146 C

[58] Field of Search ..... 222/146 C, 136, 130, 222/129.1, 129.2, 129.3, 129.4, 132, 133, 134, 135, 136

[56] References Cited

U.S. PATENT DOCUMENTS

| | | | |
|---|---|---|---|
| 2,871,675 | 2/1959 | Cornelius | 222/146 C X |
| 3,904,079 | 9/1975 | Kross | 222/146 C X |
| 3,940,019 | 2/1976 | Kross | 222/129.2 X |
| 3,949,902 | 4/1976 | Thompson | 222/129.1 |

*Primary Examiner*—Allen N. Knowles
*Attorney, Agent, or Firm*—Henry C. Kovar

[57] ABSTRACT

A post-mix carbonated beverage dispenser has an exterior cabinet, a base dividing the interior of the cabinet into first and second discrete compartments with all of the refrigeration system being in the first compartment, a drawer trackway and pull-out slide drawer in the second compartment, a fluid pressure powerable water pump and fluid pressure powerable syrup pumps fixedly mounted onto the slide drawer, flexible tubing connecting the pumps to a source of propellant gas, and further flexible tubing fluidly connecting the pumps to the refrigeration system and to a dispensing nozzle; the slide drawer with its pumps and tubing are normally visually concealed within the cabinet and are withdrawable out of the cabinet without disconnection of the tubing and while operative, to an alternative position providing substantially unobstructed access to all of the pumps and accessories upon the slide drawer.

16 Claims, 6 Drawing Figures

FIG.3
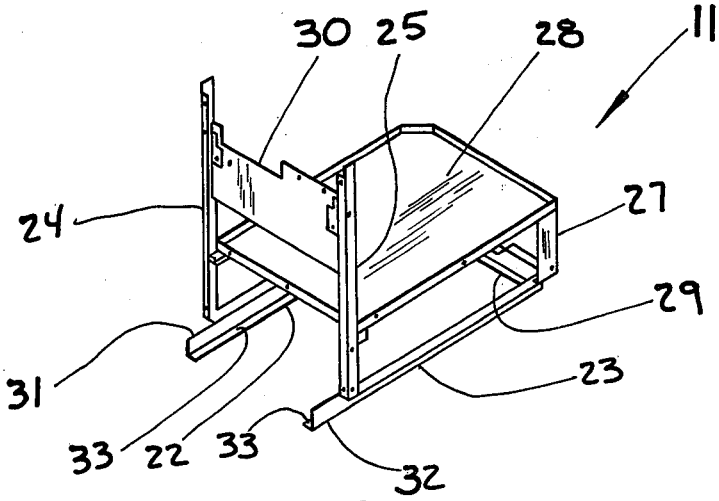
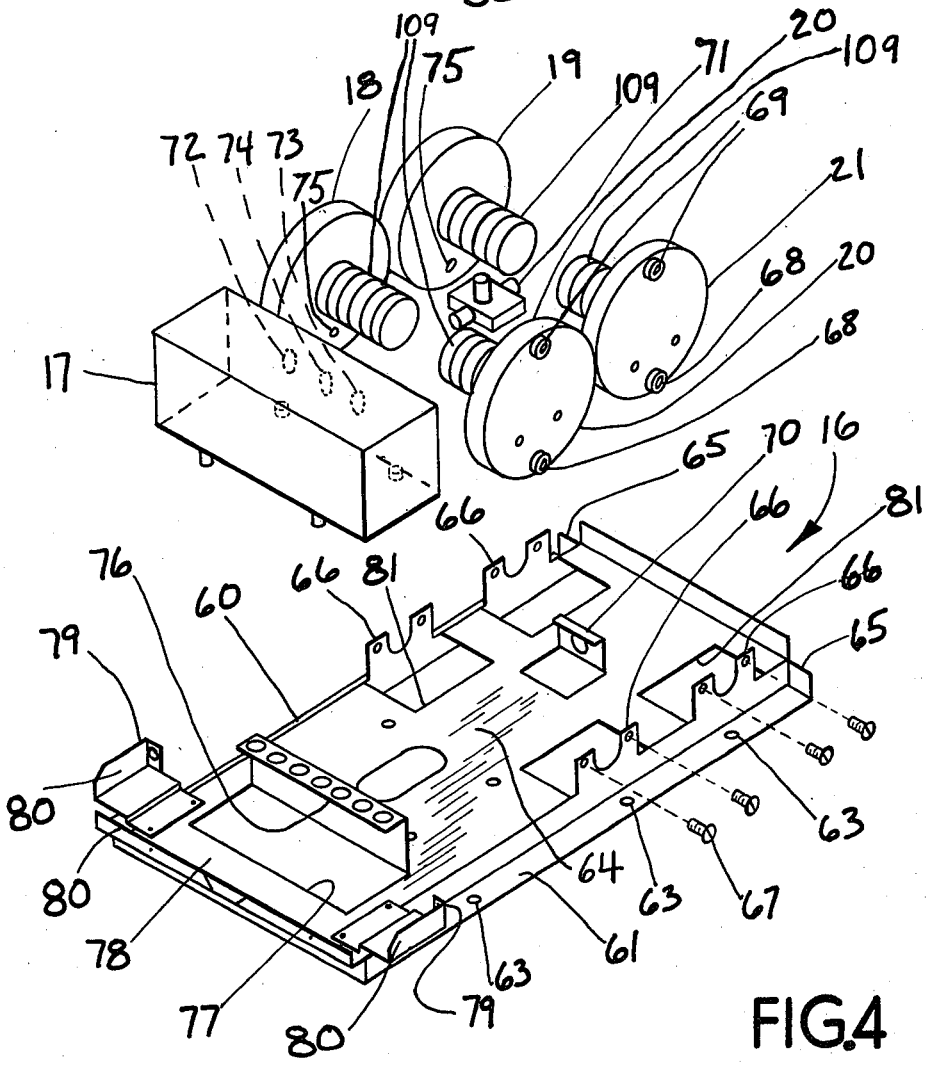
FIG.4

10
51
101
103
56
48
37
57
52
94
96
95
103
101
92
97
17
107
98
76
54
93
26
28
22
41
42
19
65
108
87
18
31
101
86
102
103
103
102
102
51
102
16

101
105
99
48
104
57
58
52
92
90,91
85
94
95
96
97
28
42
17
76
108
108
64

BEVERAGE DISPENSER

BACKGROUND OF THE INVENTION

1. Field of the Invention

This invention pertains to a countertop post-mix beverage dispenser having beverage ingredient pumps mounted upon a slidable and withdrawable drawer normally within the dispenser.

2. Description of the Prior Art

A typical prior beverage dispenser has a cooler, dispensing valves, and a carbonator. A water pump is remotely located and syrup is fed under propellant pressure to the dispenser. The water pump is fixed in a remote carbonator package and pressurized tanks are used for syrups. Rupture of pressurized syrup lines has been a problem and consequently the syrup is discharged on the floor.

Coin operated dispensers have openable front doors and various internal components have been on hinges for providing access to the components. A specific example is cup droppers and ice cube dispensers within beverage vending machines.

The propulsion or supply mechanisms for carbon dioxide gas, water and syrups have typically been of diverse type and fixed with respect to a dispensing nozzle and dispensing actuators.

The prior art has not provided for a complete propulsion mechanism which is discrete and complete from cooling mechanism and cabinetry.

OBJECTS OF THE INVENTION

It is an object of the present invention to provide a beverage dispenser which is powerable by pressurized fluid and which has fluid powerable water and syrup pumps normally concealed but withdrawable from the dispenser for access.

It is an object of the present invention to provide a beverage dispenser having a withdrawable drawer upon which is mounted fluid powerable syrup pumps, with flexible lines enabling withdrawal without disconnection of the pumps.

It is an object of the present invention to provide a beverage dispenser having a chassis and slidable drawer for withdrawal of beverage pumps from the dispenser, with the dispenser and pumps remaining operable.

It is an object of the present invention to provide a beverage dispenser having self-contained beverage ingredient pumps which are accessible without requiring dismantling or moving of the dispenser or disconnection of any fluid lines.

It is an object of the present invention to provide a beverage dispenser having pneumatically powerable water and syrup pumps, and pneumatic dispensing actuators, which has access to the pumps and actuators without disassembly or disconnection of components.

Many other advantages, features and additional objects of the present invention will become apparent to those versed in the art upon making reference to the enabling detailed description and accompanying drawings in which the preferred embodiment incorporating the principles of the present invention is set forth and shown by way of illustrative example.

SUMMARY OF THE INVENTION

In accordance with the principles of the present invention, a post-mix beverage dispenser has an exterior cabinet, a base dividing the interior of the cabinet into first and second discrete compartments, refrigeration means in the first compartment for cooling beverage ingredients, a drawer trackway in the second compartment, a slide drawer in the second compartment, the drawer is mounted on the trackway and has thereon a fluid pressure powerable syrup pump, the drawer and pump are slidably withdrawable to an alternative access position in which the pump is substantially unobstructively accessible, flexible tubing connects the pump to the refrigeration means and enables withdrawal of the drawer, and a drip tray is mounted in front of the drawer and pump.

BRIEF DESCRIPTION OF THE DRAWINGS

FIG. 3 is a downward looking perspective view from the front of the structural chassis of the dispenser of FIG. 1;

FIG. 4 is a downward looking exploded view from the front of the drawer and pumps of the dispenser of FIG. 1;

DESCRIPTION OF THE PREFERRED EMBODIMENT

Figure 1:
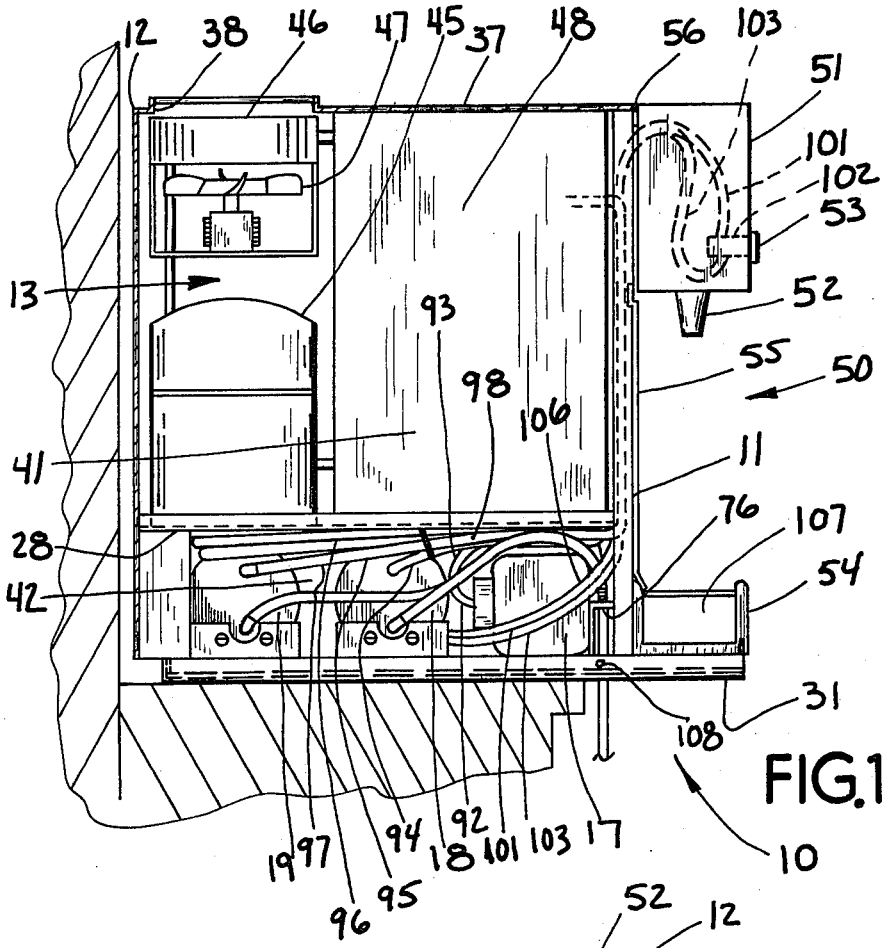
FIG. 1 is a side elevational view in partial section of the beverage dispenser of the present invention.

The principles of the present invention are particularly useful when embodied in a beverage dispenser of the type shown in FIG. 1 and generally indicated by the numeral 10. The dispenser 10 is a countertop dispenser of the post-mix type which dispenses discrete flavored syrup and water and combines the syrup and water together to form a beverage. The dispenser 10 has a chassis 11, an exterior cabinet 12, a refrigeration system 13 for cooling beverage ingredients, a hood 14 on a front end 15 of the dispenser 10, and a slide drawer 16 to which is mounted a water pump 17 and fluid powerable syrup pumps 18, 19, 20, 21.

The chassis 11 is shown in detail in FIG. 3 and has a left lower rail 22, a right lower rail 23, a pair of front upright corner posts 24, 25, a pair of back upright corner posts 26, 27 and an imperforate watertight base 28 fixed to the corner posts 24–27 and spaced parallel to and above the lower rails 22, 23. At the back of the chassis 11, the lower rails 22, 23 are structurally connected by a transverse back rail 29. The relatively tall front corner posts 24, 25 are structurally connected across the base 28 and above the base by a mounting plate 30. Each of lower rails 22, 23 has a forward extending cantilevered section 31, 32. The interior surfaces of the lower rails 22, 23 form a trackway 33 upon which the drawer 16 rests. The front of the lower rails 22, 23 is structurally fixed by weldment of the front corner posts 24, 25 to both of the base 28 and mounting plate 30, and there preferably is no transverse rail between the front of the lower rails 22, 23.

The cabinet 12 has back panel 36, a top panel 37 having an air inlet and outlet aperture 38, and left and right side panels 39, 40. The cabinet 12 is mounted to the chassis 11. The chassis base 28 flushes against the back and side panels 36, 39, 40 and divides the interior of the cabinet 12 into a discrete first or upper compartment 41, and discrete second or lower compartment 42. The cabinet 12 is secured to the chassis corner posts 24–27 and flushly fits against the lower rails 22, 23 and transverse rail 29.

The refrigeration system 13 is mounted to the chassis base 28 and is entirely within the upper compartment 41. The refrigeration system 13 includes an electrical compressor 45, a condenser coil 46, a condenser fan 47 positioned to both draw and exhaust ambient air through the top panel aperture 38, and a heat exchanger 48 for cooling beverage ingredients. Within the heat exchanger 48 is an ice bank, and discrete cooling coils for water and for each flavor of syrup. The heat exchanger 48 is mounted to the rear of the front corner posts 24, 25. The imperforate and watertight chassis base 28 precludes intake or exhaust of condenser air through the lower compartment 42, also traps all condensate and debris from the heat exchanger 48 and the air being circulated in the upper compartment 41, and precludes heat from the condenser coil 46 reaching the lower compartment 42. The refrigeration system 13 is made accessible by lifting the cabinet 12 upward off of the chassis.

The dispenser 10 has a front end generally indicated by the numeral 50, having a hood 51, a dispensing nozzle 52, beverage selector buttons 53, drip tray 54 and splash panel 55. The hood 51 is mounted to the tops of the front corner posts 24, 25 by a transverse hinge 56. A nozzle plate 57 is mounted to the chassis mounting plate 30 and supports the nozzle 52 and a lock 58 for securing the hood 51 closed. The splash panel 55 tucks under the nozzle plate 30 and overlaps the back of the drip tray 54. The splash panel 55 is on the front of the chassis front corner posts 24, 25 and is spaced forward of the heat exchanger 48.

The slide drawer 16, shown in detail in FIG. 3, has a pair of side flanges 60, 61 on the left and right sides respectively, and plastic slide buttons 62 which slidably engage and ride upon the trackway 33 in the lower compartment 42. The drawer center panel 64 is raised above the flanges 60, 61 in the form of a hat section. The center panel 64 is supported above the trackway 33 and also above the counter upon which the dispenser 10 is mounted. At the back of each side flange 60, 61 is a stop ear 65. In the back half of the drawer 16 are pump brackets 66 to which the syrup pumps 18–22 are mounted by fastener screws 67. The syrup pumps 18–22 are mounted with their inlets 68 and outlets 69 facing outward and with their spring motors 109 facing inward toward each other in opposed relationship. In between the syrup pumps 18–22 is a regulator bracket 70 to which a propellant gas pressure regulator 71 is mounted. The water pump 17 is mounted transversely upon the center panel 64 and forward of the syrup pumps 18–22. The water pump 17 has a water inlet 72, a water outlet 73 and a propellant gas connection 74 which all face to the back toward the syrup pumps 18–22. The syrup pumps 18–22 each have a propellant gas connection 75 facing inwardly. To the front of the pumps 17–22 is a bulkhead 76 for securement of fluid lines. When the drawer 16 is in its normal position in the lower compartment 42, all of the pumps 17–22 and the bulkhead 76 are within the compartment 42. The drawer 16 extends all the way to the front end of the cantilevered rail sections 31, 32 and the aperture 77 under the bulkhead 76 provides both an opening for fluid supply lines and effects a handle 78 for manual grasping and withdrawal of the drawer 16. A pair of ears 79 on each side of the front of the drawer 16 are fastenable to the bottoms of the front corner posts 24, 25 for solidification and reinforcement of the chassis 11 during shipment of the dispenser 10. Upstanding flanges 80 on the ears 79 and the handle 78 are provided for holding the drip tray 54. The syrup pumps 18–22 project downward through and nest in apertures 81 to the inside of the syrup pump brackets 66. This saves almost an inch in the height of the dispenser 10.

A water supply inlet line 85 is mounted to the bulkhead 76 and connected to the water pump water inlet 72. Syrup supply inlet lines 86, 87, 88, 89 are mounted to the bulkhead 76 and connected to the syrup pump inlets 68. The water and syrup supply inlet lines 85–89 are commonly referred to as product lines. A propellant fluid line 90 has an inlet line 91 connected to the pressure regulator 71 and to the water pump gas connection 74. A flexible water delivery line 92 extends from the water pump outlet 73 to the heat exchanger 48. The water delivery line 92 has a flexible loose length 93 normally within the lower compartment.

Syrup delivery lines 94, 95, 96, 97 run from the syrup pump outlets 69 to the heat exchanger 48. Each syrup delivery line 94–97 has a flexible loose length 98 normally within the lower compartment. These product delivery lines 92, 94–97 are all bound together and then run up the dispenser front end 50 between the heat exchanger 48 and the splash panel 55, and behind the chassis mounting plate 30. The syrup delivery lines 94–97 each go to adjustable volumetric flow controls 99 under the hood 51 and then to the heat exchanger 48. The water delivery line 92 is bound to and with the syrup delivery lines 94–97 behind the splash panel 55.

The propellant fluid line 90 has a propellant delivery line 101 from the regulator 72 in the drawer 16, to a plurality of fluid power dispensing actuators 102 in the hood 51; there is one actuator provided for each syrup pump. The propellant fluid line 90 also includes a propellant return line 103 from each actuator 102 to a respective syrup pump propellant connection 75. The propellant delivery and return lines 101, 103 are bound together and routed up the dispenser front end 50 between the heat exchanger 48 and the splash panel 55. The propellant lines 101, 103 are restrained and bound against the left side of the cabinet 12 by a clamp 104 and the flow controls 99, and are bound to the hood 51 adjacent to the transverse hinge 56 by a hood clamp 105. The propellant lines 101, 103 as well as the product lines 92, 94–98 are also retained behind the splash panel 55 by the nozzle plate 57.

Figure 2:
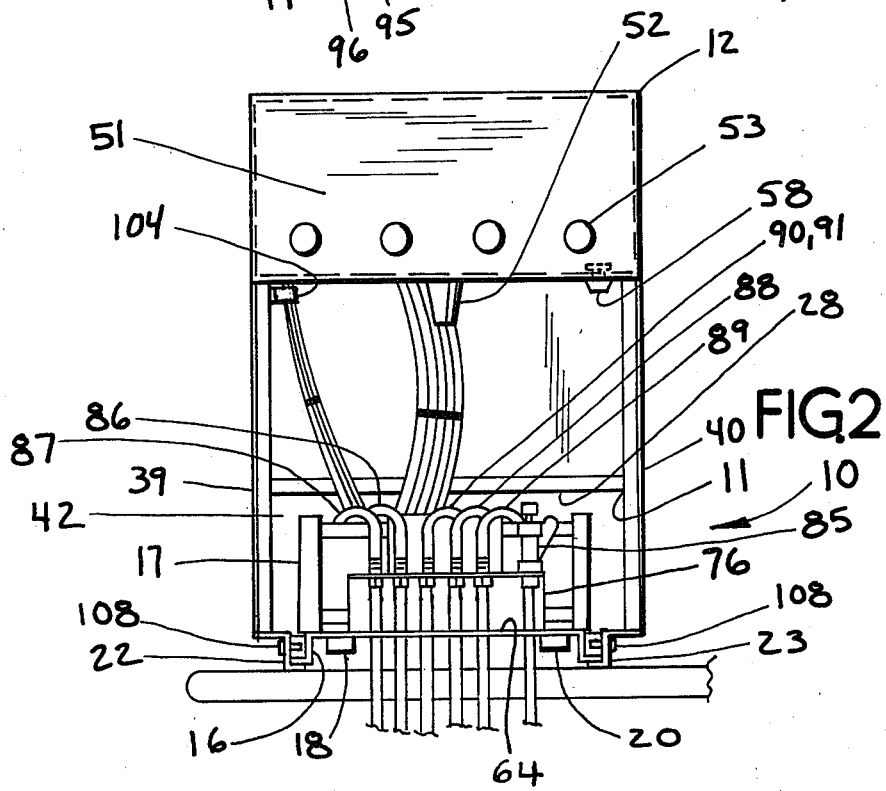
FIG. 2 is a front elevational view in partial section of the dispenser of FIG. 1.
Figure 5:
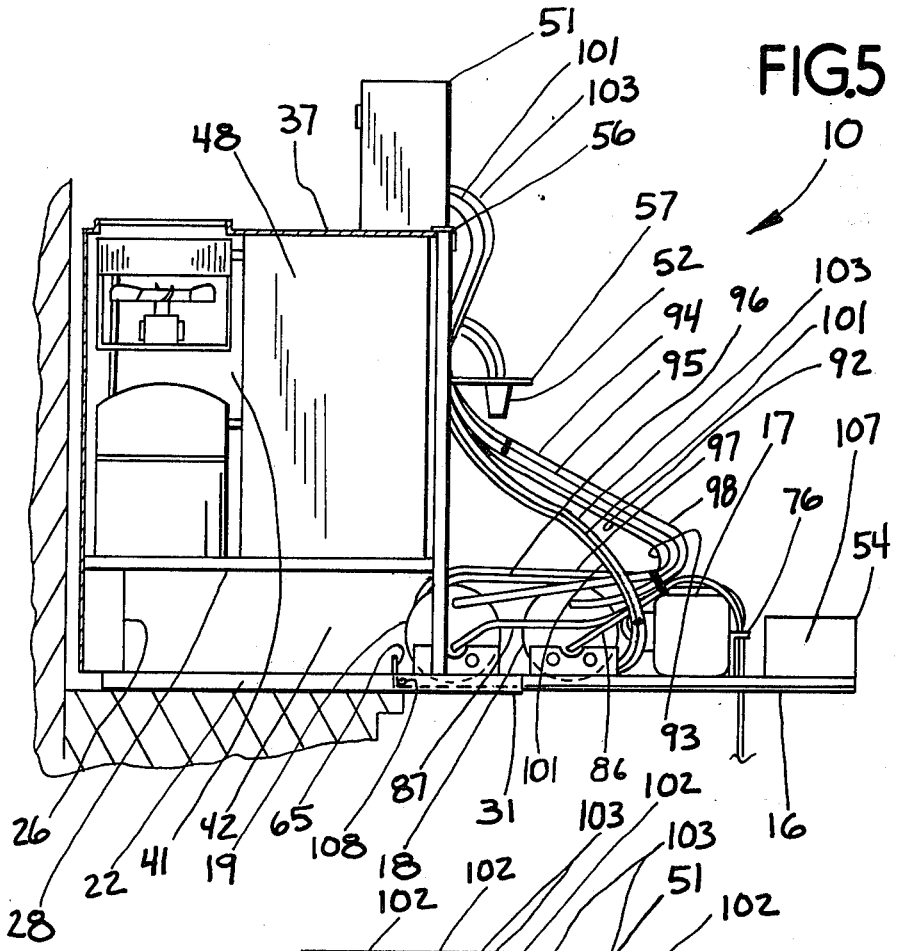
FIG. 5 is a side elevational view in partial section of the dispenser of FIG. 1 with the drawer and pumps withdrawn to a position of access.
Figure 6:
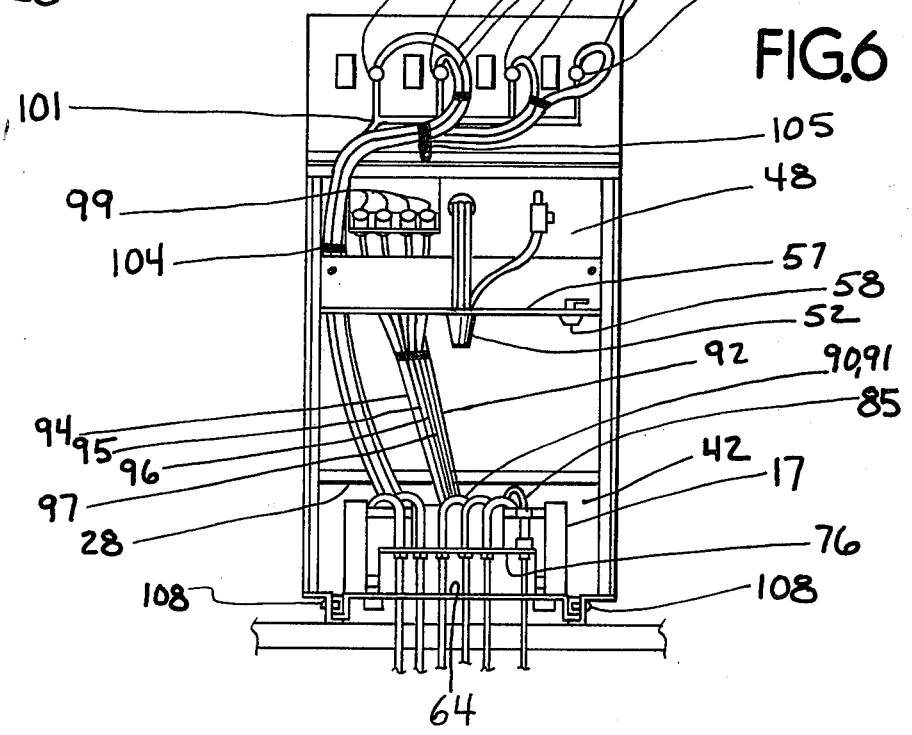
FIG. 6 is a front elevational view of the dispenser with the drawer and pumps withdrawn and the hood opened.

The hood 51 is normally closed and lockable in the position shown in FIGS. 1 and 2. As shown in FIGS. 5 and 6, the hood 51 is pivotally openable about 180 degrees around the hinge 56 to an alternate access position. The hood 51 rests upon the cabinet top panel 37 when so opened. The dispensing actuators 102, selection buttons 53 and those parts of the propellant lines 101, 103 between the actuators 102 and the hood clamp 105 are also co-pivotal with the hood 51. Access is thus precluded or given to all of the dispensing actuators 102 which are 3-way venting fluid power valves.

The drip tray 54 as shown in FIG. 1 is mounted on the dispenser front end 50 substantially at the same level as the drawer 16 and the pumps 17–21 and the tray 54 precludes visual exposure of and access to the drawer 16 and pumps 17–21. The tray 54 has sides 107 which cover and conceal the chassis cantilevered extension 31, 32. The tray 54 is held in place by the drawer flanges 80, which are also covered by the tray outer sides 107. To remove the tray 54, the splash panel 55 is removed and the tray 54 is then upwardly removable. A preferred structure for each of the fluid powerable syrup pumps 18–21 is disclosed in our co-pending U.S. Ser. No. 116,505, filed on Jan. 29, 1980. A preferred structure for the fluid powerable water pump 17 is disclosed in our co-pending U.S. Ser. No. 202,522, filed Oct. 31, 1980.

An important feature is that the drawer 16 with the pumps 17–21 and bulkhead 76 slides out of the lower compartment 42. The lower compartment 42 opens to the dispenser front 50 and drawer 16 also slides out to the front 50. After the drawer 16 has been placed into the lower compartment 42, cross bolts 108 are fastened into the lower rails 22, 23. The drawer 16 will then slide out until the stop ears 65 abut against the cross bolts 108. At this point the drawer has been withdrawn substantially out of the second compartment 42 into an alternate position. In this alternate position, the bulkhead 76, all of the pumps 17–21, the pump inlets 68, 72, pump outlets 69, 73, propellant connections 74, 75 and the product and propellant lines are all completely out of the second compartment 42 and are substantially unobstructively accessible as shown in FIGS. 5 and 6. The flexible loose lengths 98, 106 roll out of the second compartment 42 and enable the drawer 16 to be slid out.

The pumps 17–21, bulkhead 76, regulator 71 and product lines 94–98 and propellant lines 101, 103 all come out to the dispenser front end 50 under the hood 51, nozzle plate 57 and nozzle 51 to a position forward of the dispenser front 50 without requiring disconnection and leave the pumps 17–21 and the dispenser 10 completely operable regardless of whether the drawer 16 is in the normal or access position. When the drawer 16 is in the access position shown in FIG. 5, the drawer 16 is supported by the cantilevered extensions 31, 32.

This new dispenser 10 is entirely self-contained and while it can draw water and syrup from open and unpressurized containers, the entire systems of pumps and controls is quite accessible without disconnection of any tubing, or moving of the dispenser 10 from its site upon a counter. Lines from syrup and water supplies can be routed directly down from the bulkhead 76, or under the drawer 16 to the front, or under the drawer to the back. Structural integrity is provided by tying the drawer 16 to the chassis 11 during shipment.

These advantages, usages and many other usages will be found and realized by those versed in the art, and although various minor modifications may be suggested and employed by those who are versed in the art, be it known that we wish to embody within the scope of the patent granted hereon all such embodiments as reasonably come within the scope of our contribution to the art.

We claim as our invention:

1. A pressurized fluid powerable post-mix beverage dispenser comprising:

(a) an exterior cabinet having a front end with a dispensing nozzle and a drip tray;

(b) means dividing the interior of the cabinet into first and second discrete compartments;

(c) refrigeration means for cooling beverage ingredients, said refrigeration means being in the first compartment;

(d) a drawer trackway in the second compartment;

(e) a slide drawer in the second compartment, said drawer being slidably mounted to the trackway and having thereon a fluid powerable syrup pump, a bulkhead for fluid lines, a propellent fluid line from the bulkhead to the syrup pump for supply of propellent fluid to the pump, and product lines from the bulkhead to the syrup pump for supply of syrup and water respectively, said drawer being slidably withdrawable to an alternate access position in which the drawer is substantially out of the second compartment and in which the pump, bulkhead, fluid lines and product lines are forward of the cabinet front end; and (f) a product delivery line from the pump to the refrigeration means, said product delivery line including a length normally within the second compartment, said length being flexible and being forward of the cabinet front end when the drawer is in the access position, enabling slidable withdrawal of the drawer and all components thereon without disconnection of any syrup components for providing substantially unobstructed access to the pump without requiring disconnection of any line.

2. A beverage dispenser according to claim 1, including a fluid power dispensing actuator on the cabinet front end, said fluid line including a propellent delivery line from the drawer to the actuator and a propellent return line from the actuator to at least one of said pumps, each of said propellent lines having a length normally within the second compartment, said length being flexible and being alternatively forward of the cabinet front end when the drawer is in the access position enabling withdrawal of the drawer without disconnection of the lines and with the pumps remaining operative.

3. A beverage dispenser according to claim 2, including a hood hingedly mounted to the cabinet front end, said actuator being mounted to the hood and being pivotable with the hood from a normally closed position to an alternative access position in which an inside of the hood and the actuator are directly accessible, said propellent delivery and return lines being restrained between the hood and the second compartment.

4. A beverage dispenser according to either of claims 2 or 3, including a propellent pressure regulator mounted on the drawer and normally within the second compartment, said propellent fluid line including an inlet line from the bulkhead to the regulator, said propellent delivery line having an upstream end connected to the regulator.

5. A beverage dispenser according to claim 3, including a plurality of said syrup pumps, a like plurality of said actuators, and a like plurality of propellent return lines each of which is connected to a respective syrup pump and actuator, said return lines being commonly bound with the propellent delivery line.

6. A beverage dispenser according to claim 5, including means retaining the propellent and delivery lines against one side of the cabinet front end, said propellent delivery and return line also being bound to the hood.

7. A pressurized fluid powerable post-mix beverage dispenser comprising:

(a) an exterior cabinet having a front end with a dispensing nozzle and a drip tray;

(b) means dividing the interior of the cabinet into first and second discrete compartments;

(c) refrigeration means for cooling beverage ingredients, said refrigeration means being in the first compartment;

(d) a slide trackway in the second compartment;

(e) a slide drawer in the second compartment, said drawer being slidably mounted to the trackway and having thereon a fluid powerable syrup pump, a fluid powerable water pump, a bulkhead for fluid lines, a propellent fluid line from the bulkhead to the pumps for supply of propellent fluid to the pumps, and product lines from the bulkhead to the syrup and water pumps for supply of syrup and water respectively, said drawer being slidably withdrawable to an alternate access position in which the drawer is substantially out of the second compartment and in which the pumps, bulkhead, fluid lines and product lines are forward of the cabinet front end; and (f) a product delivery line from each pump to the refrigeration means, said product delivery lines each including a length normally within the second compartment, said length being flexible and being forward of the cabinet front end when the drawer is in the access position, enabling slidable withdrawal of the drawer and all water and syrup components thereon without disconnection of any of said water or syrup components for providing substantially unobstructed access to the pumps without requiring disconnection of any line.

8. A pressurized fluid powerable countertop post-mix beverage dispenser comprising:

(a) a structural chassis;

(b) a cabinet mounted on and enclosing the chassis;

(c) means in the chassis dividing an interior of the cabinet into discrete upper and lower compartments;

(d) refrigeration means for cooling beverage ingredients, said refrigeration means being mounted on the dividing means and being entirely within the upper compartment;

(e) a drawer trackway in the lower compartment;

(f) a slide drawer in the lower compartment and slidably mounted to the trackway, said drawer having thereon a water pump, a plurality of fluid powerable syrup pumps, a bulkhead for fluid lines, and fluid supply lines from the bulkhead to the pumps, said drawer and components thereon being slidably withdrawable to an alternate access position in which the drawer and the components thereon are substantially out of the second compartment for substantially unobstructed access thereto;

(g) a hood hingedly mounted on a front of the dispenser, said hood having therein fluid power dispensing actuators for control of the syrup pumps, said hood and actuators being co-pivotable into an alternate position providing access to the actuators;

(h) beverage ingredient delivery lines connecting the pumps to the refrigeration means, said lines running up behind the front of the dispenser and including lengths normally within the lower compartment which are withdrawable from the lower compartment with the drawer;

(i) a propellent delivery line from the drawer to the actuators and a propellent return line from each actuator to a respective syrup pump, said propellent lines also running up behind the front of the dispenser and including lengths normally within the lower compartment which are withdrawable from the lower compartment with the drawer; and (j) a drip tray mounted on front of the dispenser at substantially the same level as the drawer and pumps, said drip tray normally precluding exposure of and access to the drawer and pumps.

9. A beverage dispenser according to claim 8, in which said dividing means is imperforate and watertight.

10. A beverage dispenser according to claim 9, in which the cabinet encloses both left and right sides and a back of the dispenser, and in which the cabinet abutts against left and right sides and a back of the dividing means.

11. A beverage dispenser according to either of claims 8, 9 or 10, in which the lower compartment opens to the front of the dispenser, and in which the drawer is withdrawable underneath the hood and actuators.

12. A beverage dispenser according to claim 8, in which the hood is hinged to a top of the dispenser, and in which the hood rotates substantially 180 degrees to the access position.

13. A beverage dispenser according to either of claims 8 or 12, including means on the front of the dispenser for restraining the lines to the dispenser between the drawer and the actuators.

14. A fluid pressure powerable countertop post-mix beverage dispenser comprising:

(a) an exterior cabinet having a front end with a dispensing nozzle and a drip tray;

(b) a chassis within the cabinet, said chassis having a bottom, structural uprights extending upward from the bottom, and a base mounted on the upright, said base being spaced above the bottom and dividing the interior of the cabinet into discrete upper and lower compartments;

(c) refrigeration means for cooling beverage ingredients, said refrigeration means being mounted to the chassis and being in the upper compartment above the base;

(d) means defining a slide trackway in between the chassis bottom and base for slidably supporting a pump drawer within the chassis, in the lower compartment, said trackway opening to the front end of the cabinet;

(e) a pump drawer slidably mounted upon the trackway, said drawer being within the lower compartment, and having a frame, discrete syrup pumps fixedly mounted upon the frame, and a water pump fixedly mounted on the frame;

(f) stop means operatively engagable between the chassis and the drawer for positioning the drawer in a drawn out position in which all of the pumps are unobstructively accessible before the cabinet front end;

(g) resilient tubing flexibly connecting pump outlets to the refrigeration means, those parts of said tubing normally in the lower compartment together with the connections of said tubing to the pump outlets and together with inlets of the pumps all being outward of the cabinet when the drawer is in the drawn out position; and (h) means for supporting said drip tray at substantially the same level as said pumps, said drip tray normally precluding visual exposure of the pumps and the drawer.

15. A beverage dispenser according to either of claims 8 or 14, in which the trackway comprises outer lower rails of the chassis, said rails having cantilever extensions forward of the front of the dispenser a length substantially equal to the depth of the drip tray.

16. A beverage dispenser according to claim 15, in which the drip tray has sides covering the cantilevered extensions.

* * * * *